US005263344A

United States Patent [19]

Madison

[11] Patent Number: 5,263,344

[45] Date of Patent: Nov. 23, 1993

[54] SECURITY DEVICE FOR A COIN OPERATED WASHING MACHINE

[76] Inventor: Alexander G. Madison, 268 Harbor La. N., Masapaequa Park, N.Y. 11762

[21] Appl. No.: 986,335

[22] Filed: Dec. 7, 1992

[51] Int. Cl.[5] ..... E05B 73/00

[52] U.S. Cl. ..... 70/14; 70/58; 70/164; 70/417

[58] Field of Search ..... 70/1, 1.5, 14, 57, 58, 70/63, 85, 86, 158-164, 166, 416, 417, DIG. 41, DIG. 72; 109/58; 292/258, 288; 194/351

[56] References Cited

U.S. PATENT DOCUMENTS

| | | | |
|---|---|---|---|
| 1,955,462 | 4/1934 | Kaufman | 70/57 |
| 2,716,882 | 9/1955 | Gill et al. | 70/57 X |
| 3,844,144 | 10/1974 | Schmitt | 70/417 X |
| 3,926,019 | 12/1975 | Mazeika | 70/85 |
| 3,945,227 | 3/1976 | Reiland | 70/58 |
| 4,047,686 | 9/1977 | Porter | 70/58 |
| 4,194,775 | 3/1980 | Shea | 70/164 X |
| 4,350,032 | 9/1982 | Kochackis | 70/161 X |
| 4,406,358 | 9/1983 | Zahradnik | 70/159 X |
| 4,955,501 | 9/1990 | Hodge | 70/164 X |
| 5,076,531 | 12/1991 | Delaney | 70/58 X |

*Primary Examiner*—Peter M. Cuomo
*Assistant Examiner*—Suzanne L. Dino
*Attorney, Agent, or Firm*—Michael I. Kroll

[57] ABSTRACT

A security device for a coin operated washing machine having a cabinet and a coin slot mechanism housing is provided and consists of a shield attached to the cabinet for protecting the coin slot mechanism housing from vandalism, so as to prevent theft of coins and an unauthorized operation of the coin operated washing machine.

13 Claims, 2 Drawing Sheets

SECURITY DEVICE FOR A COIN OPERATED WASHING MACHINE

BACKGROUND OF THE INVENTION

1. Field of the Invention

The instant invention relates generally to anti-theft apparatuses and more specifically it relates to a security device for a coin operated washing machine.

2. Description of the Prior Art

Numerous anti-theft apparatuses have been provided in prior art that are adapted to prevent the unauthorized vandalism, damage and theft of various articles and machinery which must be protected. While these units may be suitable for the particular purpose to which they address, they would not be as suitable for the purposes of the present invention as heretofore described.

SUMMARY OF THE INVENTION

A primary object of the present invention is to provide a security device for a coin operated washing machine that will overcome the shortcomings of the prior art devices.

Another object is to provide a security device for a coin operated washing machine that will prevent the theft of coins and protect the coin slot mechanism housing from damage caused by vandalism.

An additional object is to provide a security device for a coin operated washing machine that will prevent theft of services by eliminating unauthorized access to the coin slot mechanism housing of the washing machine, that if manipulated would produce free washing of clothes.

A further object is to provide a security device for a coin operated washing machine that allows for quick removal to expedite coin collection duty.

A still further object is to provide a security device for a coin operated washing machine that is so structured that when force is applied to the device, the pressure will make it even tighter and more difficult to remove by vandalism, since the security device is stronger than the washing machine cabinet.

Another further object is to provide a security device for a coin operated washing machine that will protect a stainless steel top cover from damage by vandalism and avoid an expensive replacement cost.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
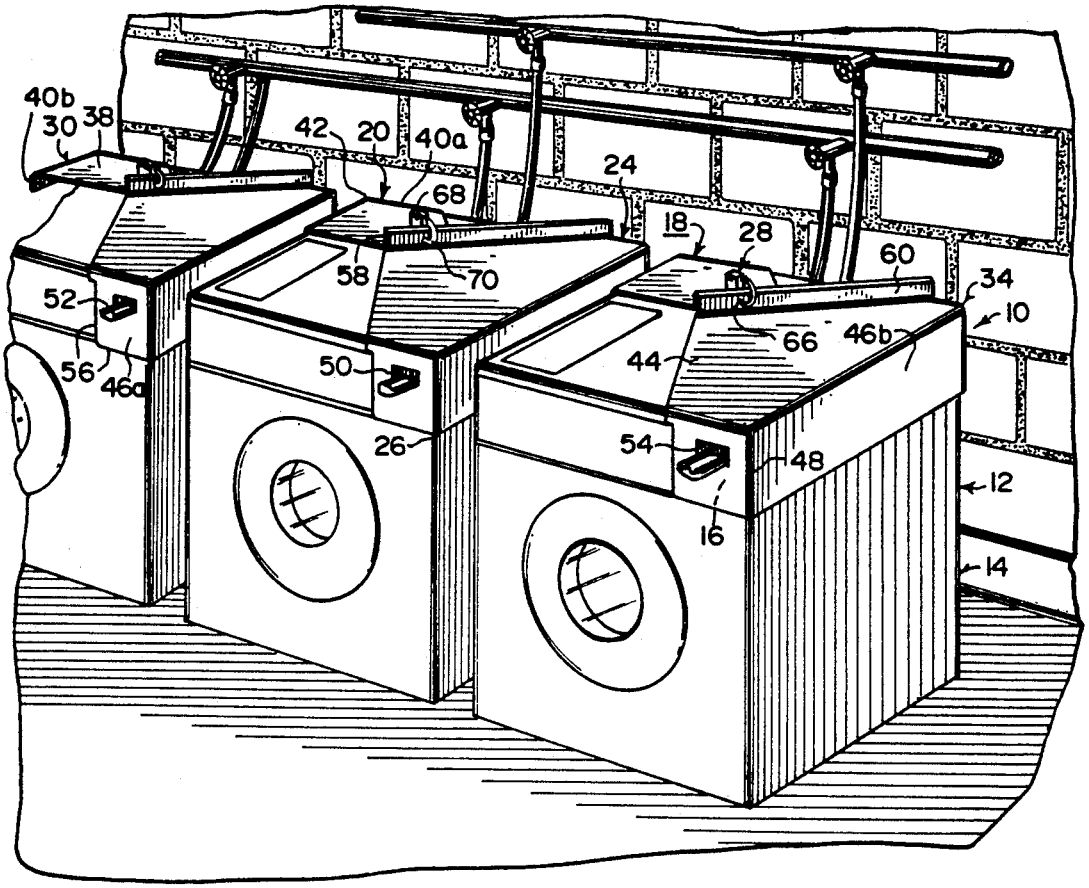
FIG. 1 is a perspective view of a commercial laundry room with the instant invention installed on coin operated washing machines.
Figure 2:
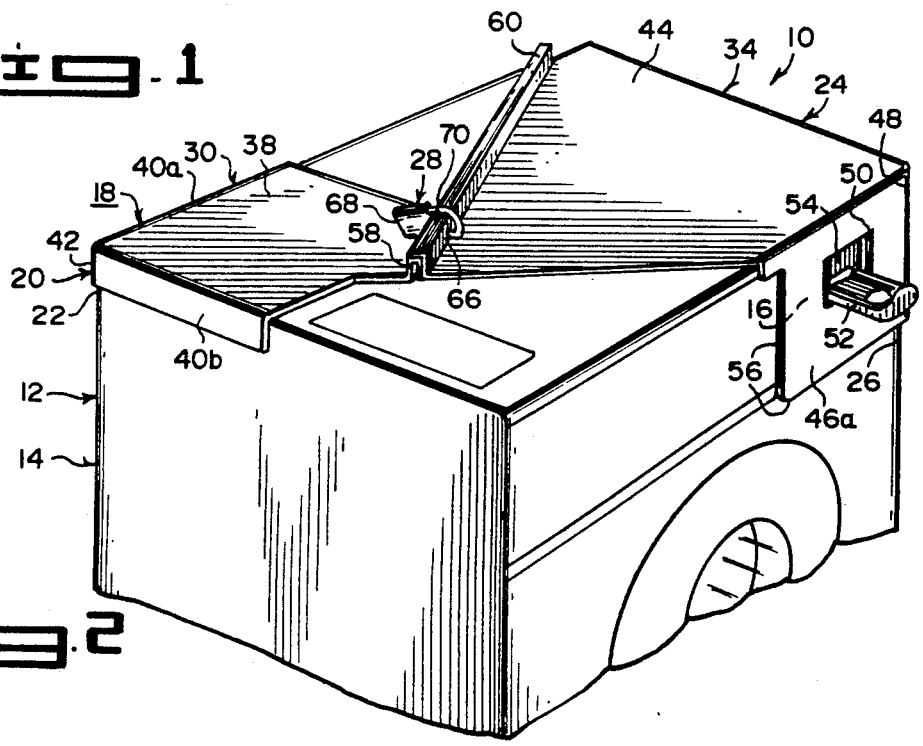
FIG. 2 is a perspective view of one of the coin operated washing machines in FIG. 1, with the instant invention installed thereon.
Figure 3:
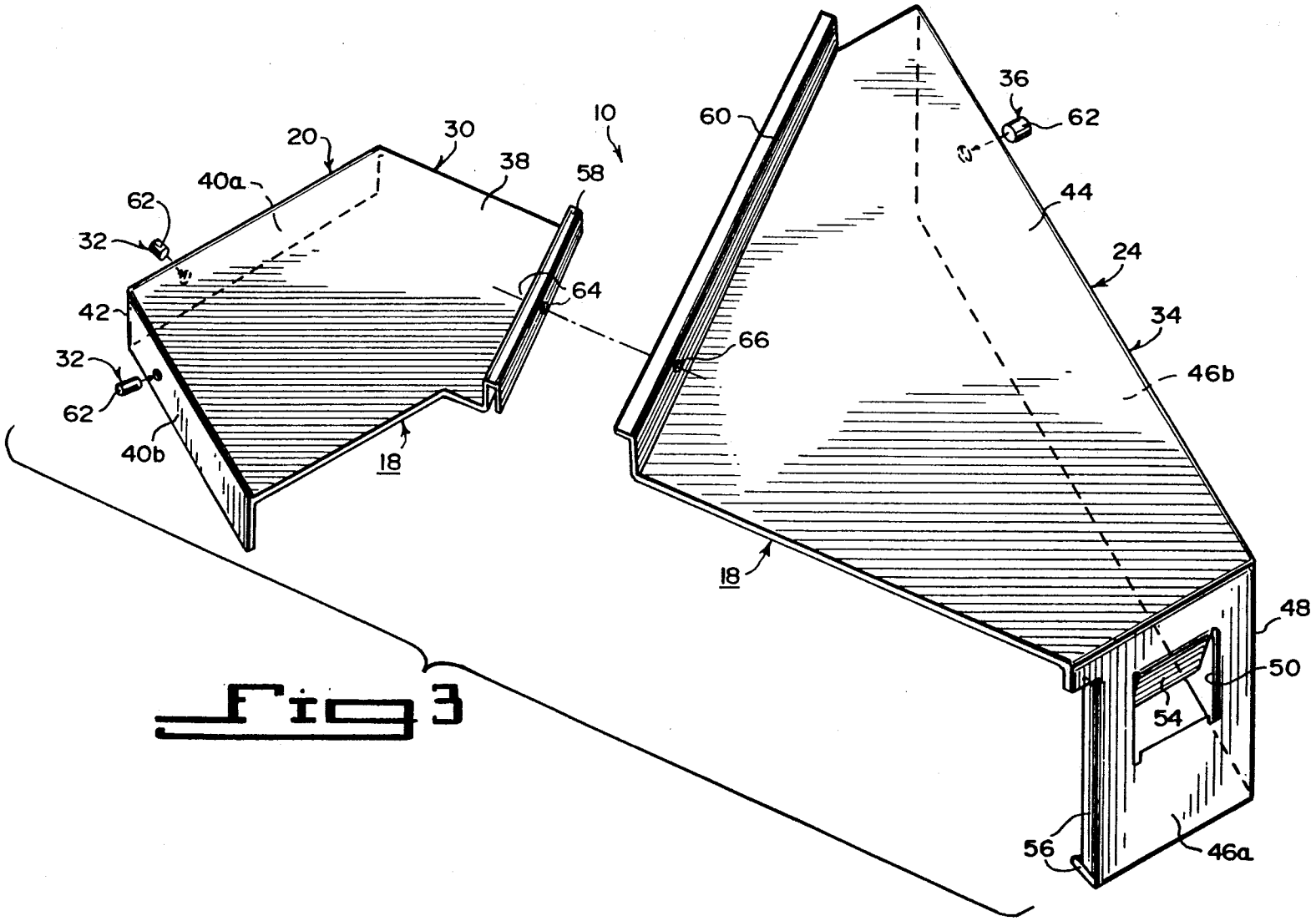
FIG. 3 is an exploded perspective view of the instant invention showing the various components thereof.

Turning now descriptively to the drawings, in which similar reference characters denote similar elements throughout the several views, FIGS. 1 through 3 illustrate a security device 10 for a coin operated washing machine 12, having a cabinet 14 and a coin slot mechanism housing 16. The device 10 consists of a shield 18 attached to the cabinet 14 for protecting the coin slot mechanism housing 16 from vandalism, so as to prevent theft of coins and an unauthorized operation of the coin operated washing machine 12.

The protecting shield 18 includes a first apparatus 20 for engaging with a rear top left corner 22 of the cabinet 14 of the coin operated washing machine 12. A second apparatus 24 is for engaging with a front top right corner 26 of the cabinet 14 and the coin slot mechanism housing 16 of the coin operated washing machine 12. A holder 28 is for securing the first engaging apparatus 20 and the second engaging apparatus 24 together to prevent an unauthorized removal from the cabinet 14 for exposing the coin slot mechanism housing 16 of the coin operated washing machine 12.

The first engaging apparatus 20 contains a first cover assembly 30 shaped to sit upon the rear top left corner 22 of the cabinet 14 of the coin operated washing machine 12. A structure 32 is for retaining the first cover assembly 30 to the rear top left corner 22 of the cabinet 14 of the coin operated washing machine 12.

The second engaging apparatus 24 includes a second cover assembly 34 shaped to sit upon the front top right corner 26 and protect the coin slot mechanism housing 16 of the coin operated washing machine 12. A structure 36 is for retaining the second cover assembly 34 to the front top right corner 26 of the coin operated washing machine 12.

The first cover assembly 30 consists of a top plate 38 and two panels **40*a* and 40*b*, each extending downwardly from an end of the top plate 38 to form a corner 42, so as to fit onto the rear top left corner 22 of the cabinet 14 of the coin operated washing machine 12**.

The second cover assembly 34 consists of a top plate 44 and two panels **46*a* and 46*b*, each extending downwardly from an end of the top plate 44 to form a corner 48, so as to fit onto the front top right corner 26 and to protect the coin slot mechanism housing 16 of the coin operated washing machine 12**.

The second cover assembly 34 further includes the front panel **46*a* having an aperture 50 therein, so that a plunger 52 of the coin slot mechanism housing 16 which receives the coins, can extend therethrough to operate. A tab 54 is formed on an upper edge of the aperture 50 in the front panel 46*a* and extends inwardly at an angle over the coin plunger 52. A lip 56 is formed on a lower edge and side edge of the front panel 46*a* to extend under and at a side of the coin slot mechanism housing 16**.

The first cover assembly 30 further contains an inverted upstanding U-shaped flange 58, formed on and extending at an angle across the top plate 38 opposite from the corner 42 of the two panels **40*a* and 40*b***.

The second cover assembly 34 further contains an inverted upstanding L-shaped flange 60 formed on and extending at an angle across the top plate 44 opposite from the corner 48 of the two panels. The L-shaped flange 60 will mate with and extend over the U-shaped flange 58 of the first cover assembly 30, when the first cover assembly 30 and the second cover assembly 34 are installed on the cabinet 14.

The first retaining structure 32 includes a pair of locking pins 62, each extending through one panel 40*a* and 40*b* of the first cover assembly and into the cabinet 14 of the coin operated washing machine 12. The second retaining structure 36 includes a locking pin 62 extending through the side panel 46*b* of the second cover assembly 34 and into the cabinet 14 of the coin operated washing machine 12.

The securing holder 28 consists of the inverted upstanding U-shaped flange 58 on the first cover assembly 30, having a pair of aligned holes 64 therethrough. The inverted upstanding L-shaped flange 60 on the second cover assembly 34 has a hole 66 therethrough aligned with the holes 64 in the inverted upstanding U-shaped flange 58. A padlock 68 having a shackle 70 extends through the holes 64 in the inverted upstanding U-shaped flange 58 and the hole 66 in the inverted upstanding L-shaped flange 60 for locking said first cover assembly 30 to the second cover assembly 34.

The first cover assembly 30 and the second cover assembly 34 are fabricated out of a durable strong material, such as two pre-finished galvanized steel sheets, each formed to be shaped and welded at respective corners 42 and 48.

LIST OF REFERENCE NUMBERS

10—security device
12—coin operated washing machine
14—cabinet of 12
16—coin slot mechanism housing of 12
18—protecting shield for 10
20—first engaging apparatus
22—rear top left corner of 14
24—second engaging apparatus
26—front top right corner of 14
28—securing holder
30—first cover assembly for 20
32—first retaining structure
34—second cover assembly for 24
36—36 - second retaining structure
38—top plate of 30
40*a*—panel of 30
40*b*—panel of 30
42—corner on 30
44—top plate of 34
46*a*—panel of 34
46*b*—panel of 34
48—corner on 34
50—aperture in 46*a*
52—coin plunger of 16
54—tab in 50
56—lip on 46*a*
58—U-shaped flange on 30
60—L-shaped flange on 34
62—locking pin
64—hole in 58
66—hole in 60
68—padlock
70—shackle on 68

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details o the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A security device for a coin operated washing machine having a cabinet and a coin slot mechanism housing, said device comprising means attahed to said cabinet for protecting said coin slot mechanism housing from vandalism, so as to prevent theft of coins and an unauthorized operation of said coin operated washing machine, said protecting means includes means for engaging with a rear left corner of said cabinet of said coin operated washing machine, means for engaging with a front top right corner of said cabinet and said coin slot mechanism housing of said coin operated washing machine, and means for securing a first engaging means and a second engaging means together to prevent an unauthorized removal from said cabinet by exposing said coin slot mechanism housing of said coin operated washing machine.

2. A security device for a coin operated washing machine as recited in claim 2, wherein said first engaging means includes:

a) a first cover assembly shaped to sit upon said rear top left corner of said cabinet of said coin operated washing machine; and b) means for retaining said first cover assembly to said rear top left corner of said cabinet of said coin operated washing machine.

3. A security device for a coin operated washing machine as recited in claim 2, wherein a second engaging means includes:

a) a second cover assembly shaped to sit upon said front top right corner and protect said coin slot mechanism housing of said coin operated washing machine; and b) means for retaining said second cover assembly to said front top right corner of said coin operated washing machine.

4. A security device for a coin operated washing machine as recited in claim 3, wherein said first cover assembly includes:

a) a top plate; and b) two panels, each extending downwardly from an end of said top plate to form a corner, so as to fit onto said rear top left corner of said cabinet o said coin operated washing machine.

5. A security device for a coin operated washing machine as recited in claim 4, wherein said second cover assembly includes:

a) a top plate; and b) two panels, each extending downwardly from an end of said top plate to form a corner, so as to fit onto said front top right corner and to protect said coin slot mechanism housing of said coin operated washing machine.

6. A security device for a coin operated washing machine as recited in claim 5, wherein said second cover assembly further includes:

a) said front panel having an aperture therein, so that a plunger of said coin slot mechanism housing which receives the coins can extend therethrough to operate;

b) a tab formed on an upper edge of said aperture in said front panel and extending inwardly at an angle over said coin plunger; and c) a lip formed on a lower edge and side edge of said front panel to extend under and at a side of said coin slot mechanism housing.

7. A security device for a coin operated washing machine as recited in claim 6, wherein said first cover assembly further includes an inverted upstanding U-shaped flange formed on and extending at an angle across said top plate opposite from said corner of said two panels.

8. A security device for a coin operated washing machine as recited in claim 7, wherein said second cover assembly further includes an inverted upstanding L-shaped flange formed on and extending at an angle across said top plate opposite from said corner of said two panels, whereby said L-shaped flange will mate with and extend over said U-shaped flange of said first cover assembly when said first cover assembly and said second cover assembly are installed on said cabinet.

9. A security device for a coin operated washing machine as recited in claim 8, wherein a first retaining means includes a pair of locking pins, each extending through one said panel of said first cover assembly and into said cabinet of said coin operated washing machine.

10. A security device for a coin operated washing machine as recited in claim 9, wherein a second retaining means includes a locking pin extending through said panel of said second cover assembly and into said cabinet of said coin operated washing machine.

11. A security device for a coin operated washing machine as recited in claim 10, wherein a securing means includes:

a) said inverted upstanding U-shaped flange on said first cover assembly having a pair of aligned holes therethrough;

b) said inverted flange on said second cover assembly having a hole therethrough aligned with said holes in said inverted upstanding U-shaped flange; and c) a padlock having a shackle extending through said holes in said inverted upstanding U-shaped flange and said hole in said inverted upstanding L-shaped flange, for locking said first cover assembly to said second cover assembly.

12. A security device for a coin operated washing machine as recited in claim 11, wherein said first cover assembly and said second cover assembly are fabricated out of a durable strong material.

13. A security device for a coin operated washing machine as recited in claim 12, wherein said durable strong material includes two pre-finished galvanized steel sheets, each formed to be shaped and welded at respective corners.

* * * * *